United States Patent [19]

Smejkal et al.

[11] Patent Number: 4,591,134

[45] Date of Patent: May 27, 1986

[54] ARRANGEMENT FOR CLEANING A LANCE HEAD OF A LANCE INTRODUCIBLE INTO A METALLURGICAL VESSEL

[75] Inventors: Hellmuth Smejkal; Walter Rockenschaub, both of Linz; Johann Fohler, Ottensheim, all of Austria

[73] Assignee: Voest-Alpine Aktiengesellschaft, Linz, Austria

[21] Appl. No.: 724,005

[22] Filed: Apr. 17, 1985

[30] Foreign Application Priority Data

May 8, 1984 [AT] Austria ..... 1507/84

[51] Int. Cl.[4] ..... C21C 5/46

[52] U.S. Cl. ..... 266/135; 266/225; 266/287

[58] Field of Search ..... 266/135, 225, 226, 287

[56] References Cited

U.S. PATENT DOCUMENTS 3,907,264 9/1975 Desaar ..... 266/135

4,052,044 10/1977 Colling et al. ..... 266/225

4,226,407 10/1980 Reinbold ..... 266/225

*Primary Examiner*—L. Dewayne Rutledge

*Assistant Examiner*—Robert L. McDowell

*Attorney, Agent, or Firm*—Brumbaugh, Graves, Donohue & Raymond

[57] ABSTRACT

An arrangement for cleaning a lance head of a lance introducible into a metallurgical vessel includes a cleaning head being in contact with the lance head during the cleaning procedure and surrounding the lance head. The cleaning head and the lance are relatively movable in the direction of the axis of the lance. In order to be able to carefully clean the lance head on its side facing the melt bath present in the metallurgical vessel by preventing the penetration of slag during the measuring procedure between the measuring and/or sampling probe and the end face of the lance, the cleaning head and the lance are placeable into an aligned position by an adjustment device. The cleaning head is settable into a rotational movement reciprocating about the axis of the lance by an oscillation device.

12 Claims, 3 Drawing Figures

ARRANGEMENT FOR CLEANING A LANCE HEAD OF A LANCE INTRODUCIBLE INTO A METALLURGICAL VESSEL

The invention relates to an arrangement for cleaning a lance head of a lance introducible into a metallurgical vessel, in particular a lance carrying a measuring and/or sampling probe, comprising a cleaning head being in contact with the lance head during the cleaning procedure and surrounding the lance head, the cleaning head and the lance being relatively movable in the direction of the axis of the lance.

From U.S. Pat. No. 3,907,264, an arrangement of this type for cleaning the end of a blowing lance is known, wherein the blowing lance is surrounded by a hollow body constituting the cleaning head and rigidly arranged, in which hollow body fingers are fastened, which contact the surface of the blowing lance and perform the cleaning thereof. By lifting the lance after the blowing procedure, the cylindrical surface of the blowing lance is slided along the fingers, being cleaned thereby.

An arrangement of this type suffers the disadvantage that the rigidly arranged cleaning head is exposed to the emissions and the thermal radiation coming from the metallurgical vessel. Furthermore, this known arrangement is suited to clean cylindrical surfaces at a lance only, whereas the front-side end surface of the blowing lance cannot be cleaned.

From U.S. Pat. No. 4,052,044, an arrangement for decrusting a blowing lance is known, in which a vibratory tool arranged laterally at a slight distance beside the blowing lance can be displaced towards the blowing lance, thus getting into contact with the cylindrical lance surface and striking off incrustations adhering thereto. The careful cleaning and re-constitution of the exact original lance surface is as little feasible by this arrangement as is the cleaning of the end face of the blowing lance.

A particular problem is faced with lances carrying measuring and/or sampling probes, whose lance head immerses into a slag layer during the sampling or measuring procedures. Such lances, as they are used, for instance, to detect temperature and carbon values in steel melts, operate with one-way probes, which are slipped onto a contact rod projecting out of the end face of the lance and drawn off the contact rod after carrying out of a measurement, i.e., after immersion into the steel melt. Therein, it is unavoidable that incrustations of slag and metal form on the outer and end faces of the lance. In some cases, e.g., with badly accommodated probes, slag or metal may enter between the end face of the lance and the end face of the probe contacting this end face. Such incrustations, if not removed, may prevent the exact contact of the measuring wires between the probe and the contact rod as a new probe is slipped on, which may result in faulty measurements.

The invention aims at avoiding these disadvantages and difficulties and has as its object to provide an arrangement of the initially defined kind, by which it is possible to carefully clean the lance head on its side facing the melt bath present in the metallurgical vessel. In particular, it is to be feasible to keep clean lances that carry sampling probes on their end faces such that the penetration of slag during the measuring procedure, at which the lance head is being immersed at least into the slag layer covering the bath, between the measuring and/or sampling probe and the end face of the lance is prevented.

This object is achieved according to the invention in that the cleaning head and the lance are placeable into an aligned position by an adjustment means and that the cleaning head is settable into a rotational movement reciprocating about the axis of the lance by an oscillation means.

Due to the reciprocating rotational movement, the removal of any incrustations, such as slag and metal splashes, on the lance head and the exact re-constitution of the original contour of the lance head are feasible. On account of the fact that the cleaning head is placeable from a position laterally beside the metallurgical vessel into a position aligned with the axis of the lance by an adjustment means (which may be effected by pivoting or displacing the lance by the adjustment means or by pivoting or displacing the cleaning head by the adjustment means), the cleaning head itself is not exposed to the emissions coming from the metallurgical vessel, so that no incrustations can form on the cleaning head itself and the exact operation of the cleaning head is ensured at any time.

In order to approach the cleaning head to the lance head in the direction of the axis of the lance without major vertical movements, i.e., not to be forced to slip it over the entire length of a contact rod when using such a contact rod, the cleaning head, according to a preferred embodiment, is designed in at least two parts in the direction of the lance axis, the parts of the cleaning head being pivotable from a straddled position beside the lance head into an operation position closedly surrounding the lance head, and vice versa, by a straddling means.

The relative movement in the direction of the lance axis between the lance and the cleaning head advantageously is realized in that the cleaning head is liftable and lowerable in the direction of the lance axis by a lifting and lowering means. By this measure, it is possible to maintain the lance in a resting position even during the cleaning process, and it suffices to lift and lower the substantially lighter cleaning head.

Suitably, the cleaning head is mounted on a vertical guide arranged on a carrier, which is adjustable in the horizontal direction away from and towards the axis of the lance.

According to a preferred embodiment, the cleaning head comprises a two-part casing, in which a likewisely two-part milling head is rotatably mounted, each of the two parts of the casing being hinged to a support displaceably mounted on the vertical guides by means of an arm fastened thereto.

To simply perform the reciprocating rotational movement, the two parts of the milling head suitably are hinged, by means of articulation rods, to a double arm articulately fastened to the center of the support, to which double arm the oscillation means is eccentrically hinged.

To move the parts of the cleaning head from the straddled position into the working position, each arm advantageously is hinged to one end each, of a cross beam horizontally movable away from and towards the cleaning head, via an articulation bracket, which cross beam is displaceable by the straddling means countermounted on the carrier, the axles of the arms of the casing parts, that are hinged to the support suitably registering with the axles of the articulation rods hinged to the double arm, with the milling head not reciprocating.

For an easier adjustment of the cleaning head into a position aligned to the axis of the lance, suitably the parts of the casing, on their partition joints, are provided with centering noses interengaging during closure into the operation position.

Preferably, the teeth of the milling head enclose an angle with one another that is smaller than the maximum angle of the reciprocating rotational movement. By appropriately choosing the number of teeth, it is possible to keep the reciprocating rotational movement, i.e., the turning angle of the cleaning head, slight.

Advantageously, the profile of the teeth of the milling head is adapted to the profile of the lance head, whereby the total lance head part that is critical with respect to depositions can be cleaned in a single cleaning procedure.

The invention will now be explained in more detail by way of one embodiment and with reference to the accompanying drawings, wherein.

Figure 1:
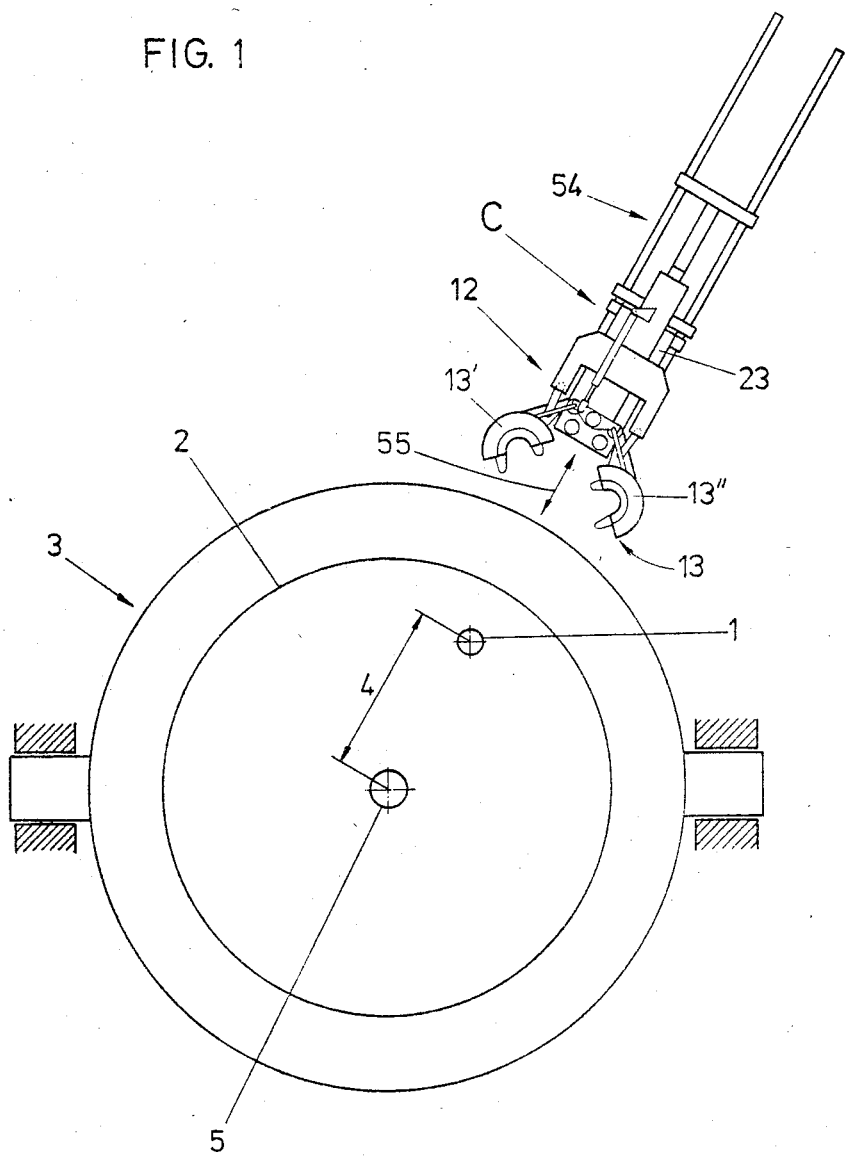
FIG. 1 is a top view of the arrangement in a schematic illustration.

A measuring lance 1 (also called sub-lance) is positioned above the mouth 2 of a steel works converter 3 at a distance 4 beside a blowing lance 5. On the lance head 6 of the measuring lance 1, a contact rod 7 for the measuring probe is provided, extending in the direction of the axis 8 of the lance 1. The lance may be lifted and lowered by means of a drive (not illustrated). During the measuring procedure, the lance 1 immerses into the melt present in the steel works converter 3, with the measuring probe slipped on the contact rod 7, through the slag floating on the melt, the lance head 6 being frequently immersed into the slag.

The lance head 6, on its end face 9, comprises an annular recess 10, into which the upper end of the measuring probe is insertable, so that the penetration of slag or melt between the measuring probe and the contact rod 7 can be prevented, as a rule. This recess 10 and the conical end face 9 of the lance head following upon the recess must be kept free from slag or metal depositions in order to be able to readily receive a new measuring probe after having carried out a measurement, i.e., after removal of a measuring probe from the contact rod 7, the contact between the contact sites 11 provided on the lower end of the contact rod and the corresponding contact sites of the measuring probe being ensured.

For this purpose, a means 12 for cleaning the lance head 6 is provided, which is equipped with a cleaning head 13, on whose upper side a milling head 14 is arranged. The cleaning head 13 is comprised of two parts 13', 13'', which complement each other to form a hollow cylinder. The partition joints 15 extend vertically, i.e., through the axis 16 of the cleaning head 13. The cleaning head 13 comprises a likewisely divided casing 17, in which the dividedly designed milling head 14 is supported so as to be rotatable in the horizontal and vertical directions by means of rollers 18. Each part 17', 17'' of the casing 17 is provided with one cantilever arm 19 pivotably fastened to a support 21 by means of a vertically extending axle 20, whereby the parts 17', 17'' of the casing 17 and the parts 14', 14'' of the milling head 14 mounted therein are movable like tongs, i.e., from a straddled position A illustrated in FIG. 3 in dot-and-dash lines into a closed operation position B illustrated in FIG. 3 in full lines.

The support 21 is mounted on a carrier 23 so as to be liftable and lowerable in the direction of the axis 16 of the cleaning head 13 by means of two vertical guides 22. A pressure medium cylinder 24 hinged to the carrier serves to lift and lower the same, its piston rod 25 being hinged to a pivot lever 26 articulately fastened to the carrier 23 by means of a pivot axle 27. To the pivot lever 26, a bracket 28 is hinged, whose other end is articulately fastened to the support 21 such that a pivotal movement of the pivot lever 26 about its pivot axle 27 causes the lifting and lowering of the support 21.

Closing into the operation position B and opening into the straddled position A, of the cleaning head, is effected by a pressure medium cylinder 29 fastened to the support 21, whose piston rod 30 engages at a cross beam 31 approximately in its middle, which cross beam 31 is articulately connected, by one end 32, 33 each, with one of the arms 19 cantilevering from the parts 17', 17'' of the casing 17, via articulation brackets 34. By displacing the cross beam 31 in the direction of the arrow 35 into the position illustrated in dot-and-dash lines in FIG. 3, the arms 19 are pivoted about their axles 20, the parts 13', 13'' of the cleaning head 13 thus being moved from each other into the straddled position A.

To carry out a reciprocating rotational movement of the milling head 14, a horizontally directed semicircular plate 36 is provided on each part 14', 14'' of the milling head 14, which plates are both located within the casing 17 of the cleaning head 13. To each of these plates 36, an articulation rod 37 is hinged by one end. The opposite ends of these two articulation rods 37 are articulately connected by means of a double arm 38 pivotably mounted in the middle of a pivot axle 39 fastened to the support 21. One of the arms of the double arm 38 is engaged by the piston rod 41 of a pressure medium cylinder 42 eccentrically, i.e., at a distance 40 from the pviot axle 39, the pressure medium cylinder 42 being countermounted on the support 21.

Figure 3:
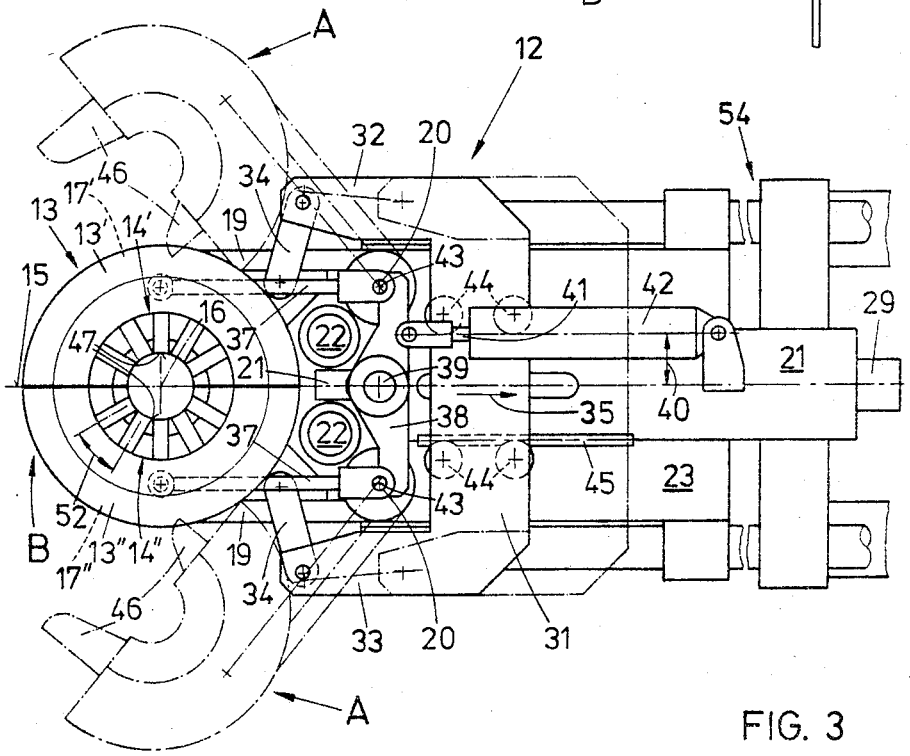
FIG. 3 is a plan view of the arrangement.

As is apparent from FIG. 3, the axles 43, by which the articulation rods 37 are fastened to the double arm 38, register with the axles 20, by which the arms 19 are hined to the support 21, with the milling head 14 not reciprocating, i.e., with the double arm 38 being in the central position. Due to this measure, the milling head parts 14', 14'' do not carry out a rotational movement as the cleaning head 13 is being straddled or closed. To guide the cross beam 31 during displacement thereof for the purposes of straddling or closing the cleaning head 13, guide rollers 44 serve which are rotatably journaled on the cross beam 31 and are guided on a guide rule 45 fastened to the support 21.

In order to safely seize the contact rod 7 with the parts 13', 13'' of the cleaning head 13 centrically during pivoting from the straddled position A into the operation position B, both parts 17', 17'' of the casing 17 are provided with centering noses 46 projecting beyond the partition joints 15. To safely guide the cleaning head 13 in the direction of the axis 8 of the lance 1, likewisely divided cylinder guiding surfaces 47 are provided in the casing 17, each formed by half a circular-ring plate 48, on which the centering noses 46 are preferably provided. To further center the contact rod 7, radially arranged adjustment screws 49 are provided in the plates 36, whose ends 50 abut on the contact rod 7.

The teeth 51 of the milling head 14 have a profile adapted to the lance head 6. Viewed in the ground section, they enclose an angle 52 that is smaller than the maximum angle of the reciprocating rotational movement. A lid 53 mounted on the milling head (also designed in two parts) serves to protect the rollers 18.

Figure 2:
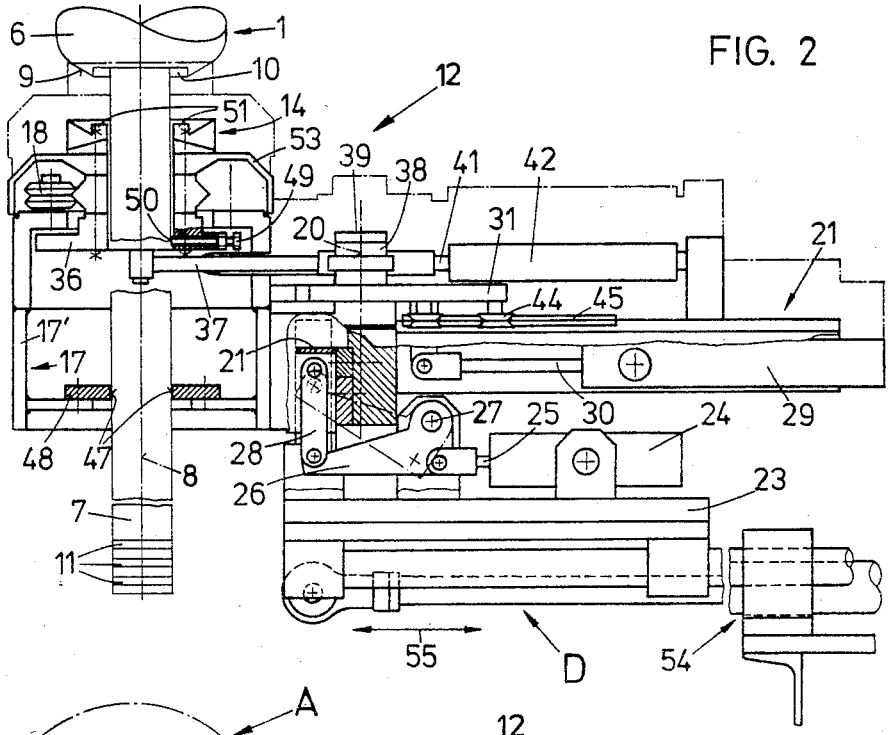
FIG. 2 is a partially sectioned side view of the arrangement according to the invention.

The carrier 23 carrying the support 21 is displaceable and pivotable, by an adjustment means 54, from a resting position C (FIG. 1) laterally beside the converter 3 into the position D illustrated in FIGS. 2 and 3, in the direction of the double arrow 55, in which the axis 16 of the cleaning head 13 placed into the operation position B registers with the axis 8 of the lance 1.

The arrangement functions in the following manner:

As soon as the measuring probe has been removed from the contact rod 7 after carrying out a measurement, the carrier 23 of the arrangement 12 is displaced or pivoted into the position D illustrated in FIGS. 2 and 3 by the adjustment means 54. The parts 13', 13'' of the cleaning head 13 are then in the straddled position A, the support 21 being in the lowered position illustrated in FIG. 2 in full lines. Subsequently, the parts 13', 13'' of the cleaning head 13 are pivoted into the operation position B, the support 21 and, thus, the cleaning head 13 are lifted into the position illustrated in FIG. 2 in dot-and-dash lines and, at the same time, the milling head 14 is set in a reciprocating rotational movement.

Slag and metal deposits adhering to the lance head 6 are thereby carefully removed and the lance head 6 again represents its original profile after the reciprocal movement has been perfomed, so that the next measuring probe will tightly lie at the lance head 6 after being slipped onto the contact rod 7, thus preventing the penetration of slag or metal between the lance head 6 and the measuring probe.

After cleaning, the cleaning head 13 is lowered and its parts 14', 13'' are placed in the straddled position A. Thereafter, the carrier 23 is pivoted and moved away from the area of the metallurgical vessel with the help of the adjustment means 54.

The invention is not limited to the embodiment illustrated in the drawings, but may be modified in various aspects. Thus, it may, for instance, be used to remove metal and slag splashes depositing on the nozzle star of blowing lances, the teeth of the milling head 14, in that case, being adapted to the contour of the nozzle star. In that case, the casing 17 is centered on the blowing lance itself; it extends upwardly from the milling head 14.

It is not necessarily required to move the carrier 23 towards the lance head 6 by the adjustment means 54 for the purpose of cleaning the same; it is also possible to move the lance 1 towards the cleaning head, which is of a particular advantage if the lance 1 is arranged on a displaceable lance car.

The arrangement 12 according to the invention is suited for cleaning lance heads of any type, e.g., even for lances inserted in ladles or any other metallurgical vessels.

It is possible to use dividable brushes, for instance, scratch brushes, adapted to the contour of the lance head, instead of the milling head.

What we claim is:

1. In an arrangement for cleaning a lance head of a lance introducible into a metallurgical vessel, such as a lance carrying a measuring and/or sampling probe, of the type including a cleaning head being in contact with said lance head and peripherally surrounding said lance head during said cleaning, said lance having a lance axis in the direction of which said cleaning head and said lance are relatively movable, the improvement which comprises an adjustment means adapted to place said cleaning head and said lance into aligning positions, and an oscillation means adapted to set said cleaning head into a rotational movement reciprocating about said lance axis.

2. An arrangement as set forth in claim 1, wherein said cleaning head, in the direction of said lance axis, is designed so as to comprise at least two cleaning head parts, and further comprising a straddling means adapted to pivot said cleaning head parts from a straddled position beside said lance head into an operation position closedly surrounding said lance head, and vice vers.

3. An arrangement as set forth in claim 1, further comprising a lifting and lowering means adapted to lift and lower said cleaning head in the direction of said lance axis.

4. An arrangement as set forth in claim 3, further comprising a carrier displaceable in the horizontal direction away from and towards said lance axis, and vertical guide means arranged on said carrier for mounting said cleaning head.

5. An arrangement as set forth in claim 4, further comprising a two-part casing provided for said cleaning head, a two-part milling head rotatably mounted in said two-part casing, a support displaceably mounted on said vertical guide means, and an arm fastened to each part of said two-part casing for hinging said casing part to said support.

6. An arrangement as set forth in claim 5, further comprising a double arm hinged to said support in its middle to articulately receive said oscillation means eccentrically, and articulation rods provided for said two milling-head parts to hinge said milling-head parts to said double arm.

7. An arrangement as set forth in claim 5, further comprising a cross beam horizontally displaceable away from and towards said cleaning head by said straddling means countermounted on said carrier, and an articulation bracket for hinging said arm to one end of said cross beam.

8. An arrangement as set forth in claim 7, wherein said arms of said casing parts hinged to said support have first axle means and said articulation rods hinged to said double arm have second axle means, said first and second axle means registering with said milling head not reciprocating.

9. An arrangement as set forth in claim 5, wherein said casing parts define partition joints between them, and which further comprises centering noses provided on said partition joints and interengaging during closure into the operation position.

10. An arrangement as set forth in claim 5, further comprising teeth provided on said milling head and enclosing an angle that is smaller than the maximum angle of the reciprocating rotational movement.

11. An arrangement as set forth in claim 10, wherein said teeth of said milling head have a profile adapted to the profile of said lance head.

12. An arrangement as set forth in claim 1, wherein said cleaning head is placeable from a resting position laterally beside said metallurgical vessel into a position in alignment with said lance by said adjustment means.

* * * * *

UNITED STATES PATENT AND TRADEMARK OFFICE

CERTIFICATE OF CORRECTION

PATENT NO. : 4,591,134

DATED : May 27, 1986

INVENTOR(S) : Smejkal et al.

It is certified that error appears in the above-identified patent and that said Letters Patent is hereby corrected as shown below:

Col. 1, before line 6, insert --BACKGROUND OF THE INVENTION--; between lines 58 and 59, insert --SUMMARY OF THE INVENTION--. Col. 3, between lines 18 and 19, insert --BRIEF DESCRIPTION OF THE DRAWINGS--; between lines 26 and 27, insert --DETAILED DESCRIPTION OF THE INVENTION--. Col. 4, line 39, "pviot" should read --pivot--; line 44, "hined" should read --hinged--. Col. 5, line 29, "perfomed" should read --performed--; line 35, "14'" should read --13'--. Col. 6, line 15, "vers" should read --versa--.

Signed and Sealed this

Seventh Day of October, 1986

[SEAL]

*Attest:*

DONALD J. QUIGG

*Attesting Officer*

*Commissioner of Patents and Trademarks*